US006551135B2

(12) United States Patent
Stekelenburg

(10) Patent No.: US 6,551,135 B2
(45) Date of Patent: Apr. 22, 2003

(54) ELECTRICAL TERMINAL BLOCK WITH CASE COVER

(75) Inventor: Albert Stekelenburg, Taipei (TW)

(73) Assignee: All-Line Inc., Taipei (TW)

( * ) Notice: Subject to any disclaimer, the term of this patent is extended or adjusted under 35 U.S.C. 154(b) by 0 days.

(21) Appl. No.: 09/901,634

(22) Filed: Jul. 11, 2001

(65) Prior Publication Data

US 2002/0142652 A1 Oct. 3, 2002

(30) Foreign Application Priority Data

Mar. 28, 2001 (TW) ..... 90204690 U

(51) Int. Cl.[7] ..... H01R 13/60; H01R 13/66; H01R 13/62

(52) U.S. Cl. ..... 439/575; 439/367

(58) Field of Search ..... 439/575, 654, 439/214, 144, 367

(56) References Cited

U.S. PATENT DOCUMENTS 6,086,397 A * 7/2000 Chapman et al. ..... 439/214
6,174,199 B1 * 1/2001 Rushing ..... 439/575

* cited by examiner

*Primary Examiner*—Lynn D. Feild
*Assistant Examiner*—Chandrika Prasad
(74) *Attorney, Agent, or Firm*—Troxell Law Office PLLC

(57) ABSTRACT

A terminal block having a case cover. A body of case cover is installed on the back side of the terminal block, with a plurality of legs and openings formed by the body of case cover. A through-hole for an electric cord is also formed on the body. The case cover protects the power tap and provides an artistic appearance.

9 Claims, 4 Drawing Sheets

ELECTRICAL TERMINAL BLOCK WITH CASE COVER

FIELD OF THE INVENTION

This invention relates to an electrical terminal block having a case cover, more particularly one in which the cover acts as a protective structure for the terminal block for utilization of an extension cord.

BACKGROUND OF THE INVENTION

Most of the current mobile terminal blocks have a power tap, with a number of plugs and conductors, which is convenient in practice, having been extensively utilized. However, this known type of terminal block suffers from the impact of external forces in application, which causes the terminal block to be operated in an unsafe state.

SUMMARY OF THE INVENTION

An object of the invention is to provide a terminal block having a case cover with a power tap mounted beneath a solid case cover, such that the plug holes of the power tap are directed downwards, and the power tap is protected by the case cover.

Another object of the invention is to provide a terminal block having a case cover with a plurality of legs, openings, and a through hole for gripping the conductor, such that the terminal block of the invention can be firmly installed on the ground or other places. A certain distance is formed between the terminal block and the ground, which allows other plugs to be inserted into the power tap via the openings.

A further object of the invention is to provide a terminal block having a case cover with the power tap mounted on the inner side of the case cover, to provide safer operating conditions. The legs of the case cover may be further designed to have attaching pin holes, guaranteeing safe operation of the terminal block.

The terminal block of the invention also has a case cover with an artistic appearance, providing visual delight to the user.

The terminal block of the invention comprises a case cover body and a power tap. The body consists of a case cover, with a plurality of legs formed by extensions of the case cover, openings being formed between the adjacent legs. A through-hole for an electric cord is formed on a leg, and a plurality of reinforcing ribs are formed in the case cover. The power tap is mounted on the inner side of the case cover, with enough space being maintained between the socket face and the ends of the legs for plugs to be inserted into the power tap. The power tap may be removably mounted on the case cover. An attaching pin hole or a screw hole may be formed on a leg of the case cover. Also, an adhesive may be bonded on the bottom portion of a leg of the case cover.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

Figure 1:
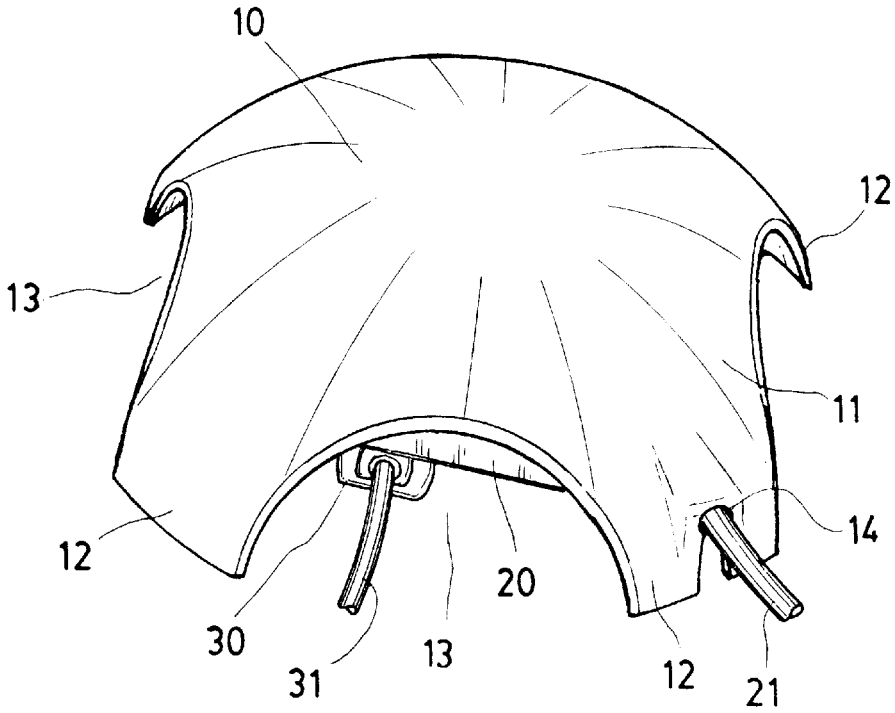
FIG. 1 is a perspective view of the present invention.
Figure 2:
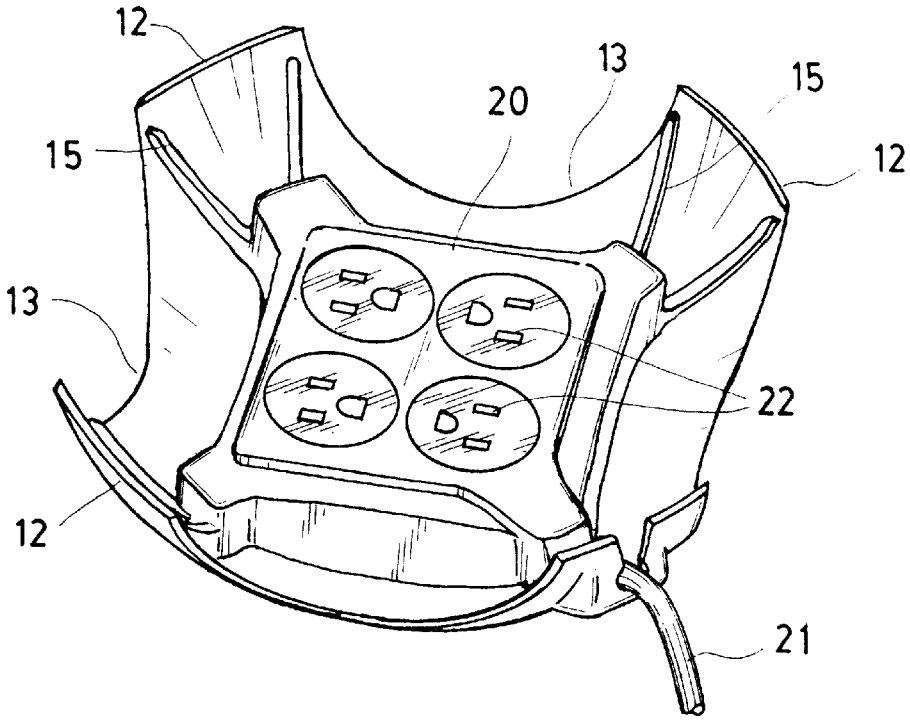
FIG. 2 is an inverted perspective view of the invention.

As shown in FIGS. 1 and 2, terminal block of the invention consists of a body 10 and a power tap 20 disposed on an inner side of the body 10.

The body 10 comprises a case cover 11, a plurality of legs 12, a plurality of openings 13, a power-line through hole 14 and a plurality of reinforced ribs 15. The case cover 11, legs 12, openings 13, electric cord through-hole 14, and reinforced ribs 15 can be integrally formed by solid material.

Case cover 11 is shrouded over and covers the power tap 20, which protects the power tap 20, and may provide an artistic diversified appearance.

Legs 12 are formed from the extension of case cover 11, and the structure of the invention may be firmly disposed on the ground or other support surfaces. Openings 13 are formed by the space between the adjacent legs 12, such that electric conductors may pass through the interval.

Power-line through-hole 14 is formed on at least one leg 12, and provides a stable installation for the power-line 21 of power tap 20.

The power tap 20 comprises a power-line 21 and a plurality of plug holes 22, with a distance between plug holes 22 of power tap 20 and the plane formed by the ends of the legs 12 providing enough space for insertion of plug 30 with an electric conductor 31 via an opening 13.

Figure 3:
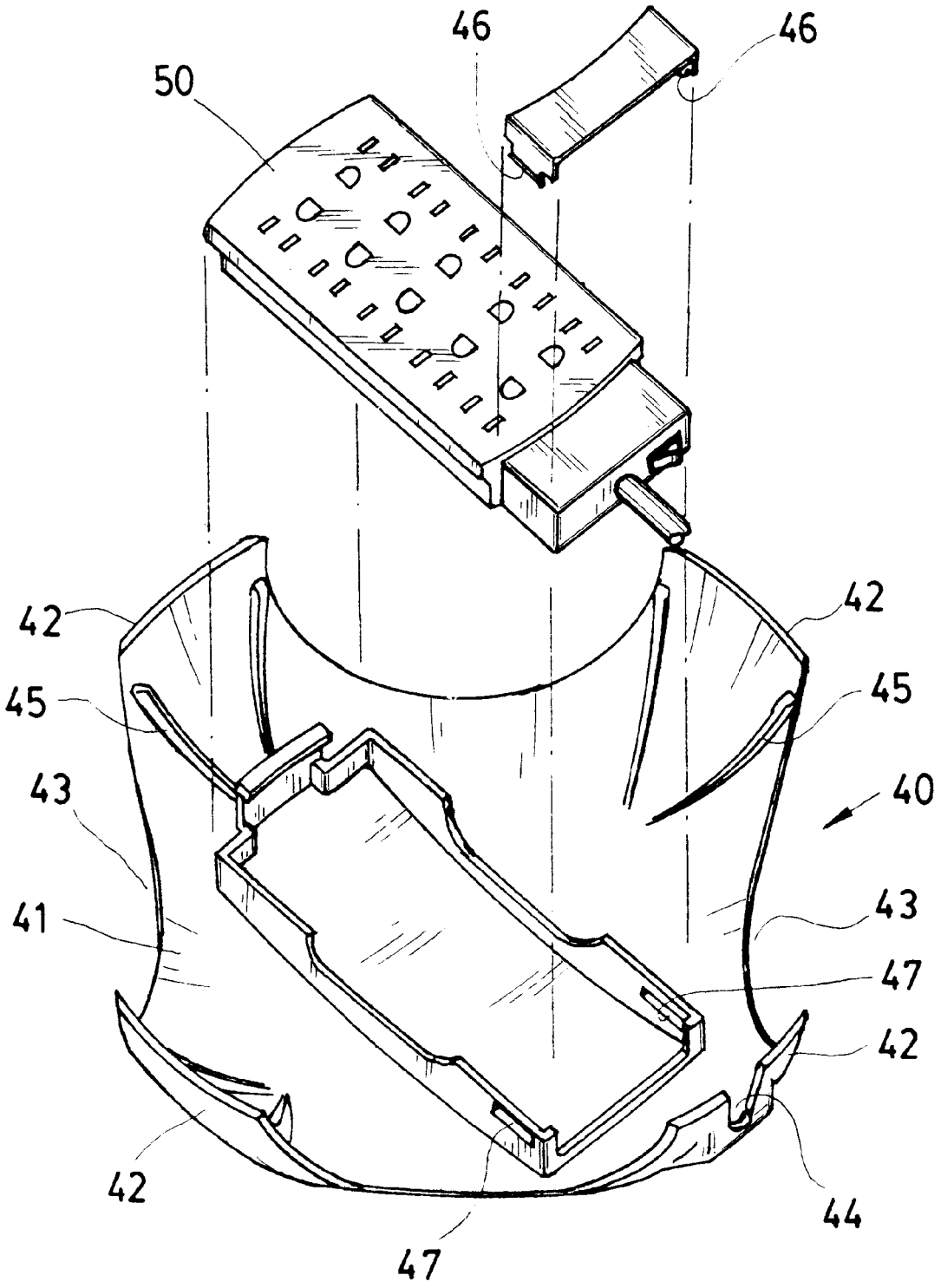
FIG. 3 is an exploded view of another embodiment of the invention.

As shown in FIG. 3, a body 40 of the case cover may have a power tap 50 removably mounted inside the body 40. The body 40 comprises a case cover 41, legs 42, openings 43, electric cord through-hole 44 and reinforced ribs 45, as in the previous embodiment, but also a structure for removably gripping the power tap 50 installed inside the case cover 41. The power tap 50 may be mounted or removed by attaching or removing the fasteners 46 from location holes 47.

Figure 4:
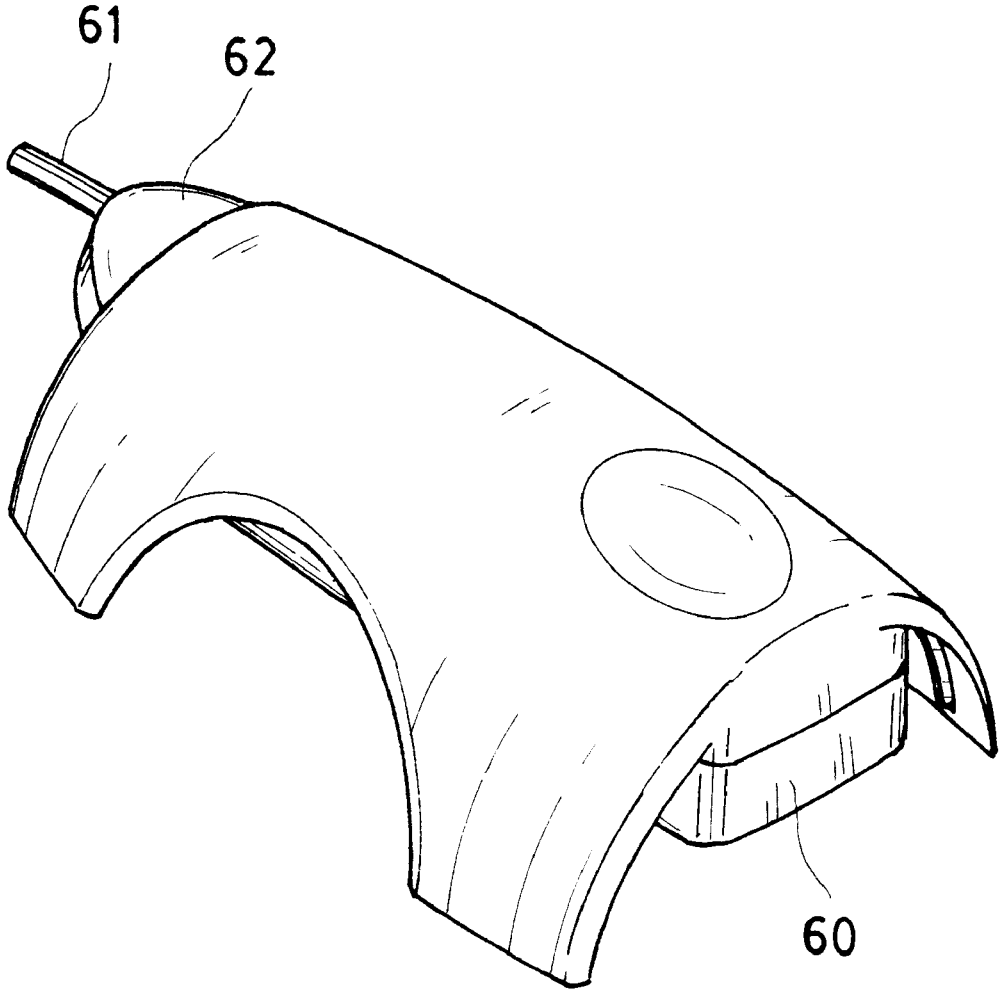
FIG. 4 is a perspective view of another embodiment of the invention.

Another embodiment is shown in FIG. 4, wherein the electric cord 61 extends from the power tap 60 via a fixed portion 62.

Figure 5:
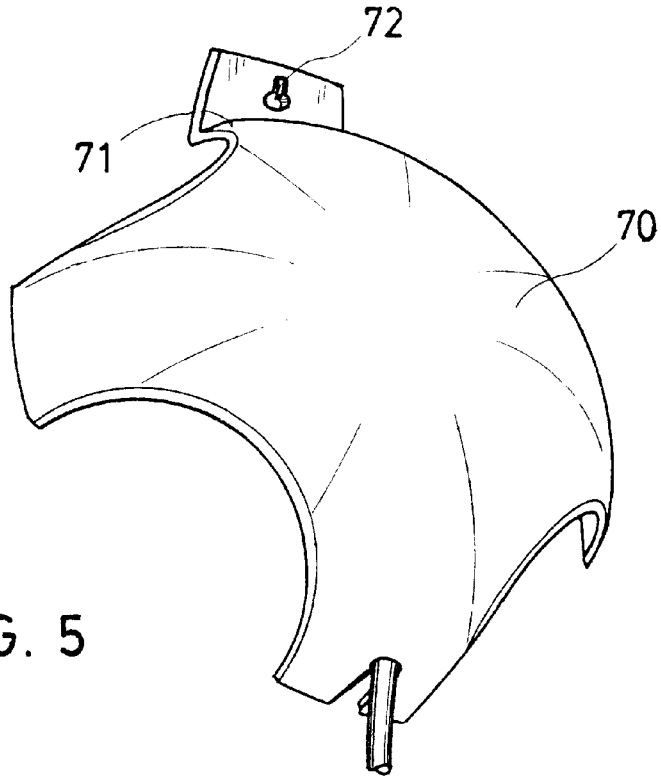
FIG. 5 is a perspective view of another embodiment of the invention.

A further embodiment is shown in FIG. 5, in which an attaching pin hole 72 is formed on a leg 71 of body 70 of the case cover, so that terminal block of the invention may be hung on a wall.

Figure 6:
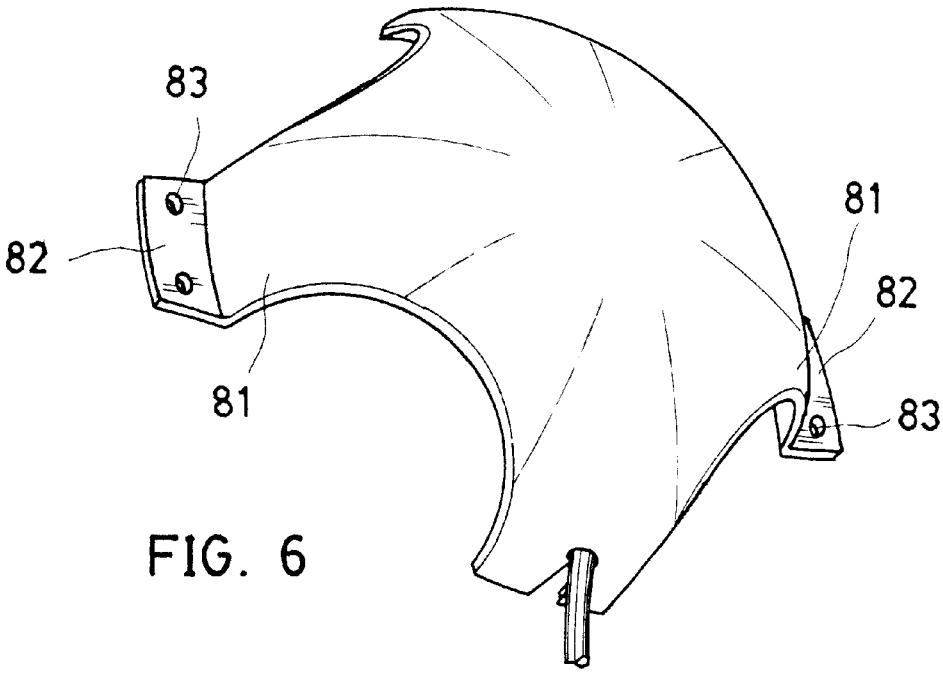
FIG. 6 is a perspective view of still another embodiment of the invention.

Still another embodiment is shown in FIG. 6 in which an additional planar mounting member 82 is formed on the side of legs 81, having a screw hole 83, so that terminal block of the invention can be mounted in a desired position. An adhesive can also be installed at the bottom side of planar member 82, whereby the terminal block may be firmly bonded on a surface.

In summary, the invention provides a terminal block having a case cover, which protects the terminal block and has an artistic appearance.

The foregoing description is provided for illustrative purposes only and should not be construed as limiting this invention, the scope of which is defined solely by the appended claims.

What is claimed is:

1. An electrical terminal block assembly comprising;

a) a case cover having: a convexly curved outer surface; a plurality of legs integrally formed on the case cover with openings between adjacent legs; and an inner surface with a generally concave configuration; and, b) an electrical power tap having at least one plug hole in one side thereof and a power line extending therefrom, the electrical power tap mounted on the inner surface of the case cover such that the at least one plug hole faces toward and is spaced from a plane formed by ends of the plurality of legs of the case cover, thereby enabling a plug to be inserted into and removed from the at least one plug hole.

2. The electrical terminal block of claim 1 wherein the electrical power tap is removably mounted to the inner surface of the case cover.

3. The electrical terminal block of claim 2 further comprising at least one fastener clip engaging the electrical power tap and releasably engaging location holes formed in the inner surface of the case cover.

4. The electrical terminal block of claim 1 wherein the electrical power tap is non-removably mounted to the inner surface of the case cover.

5. The electrical terminal block of claim 1 further comprising a through hole in at least one of the plurality of legs, wherein the power line of the electrical power tap passes through the through hole.

6. The electrical terminal block of claim 1 further comprising an attaching-pin hole formed in at least one of the plurality of legs of the case cover.

7. The electrical terminal block of claim 1 further comprising a planar mounting member extending outwardly from an end of at least one of the plurality of legs of the case cover.

8. The electrical terminal block of claim 7 wherein the planar mounting member has at least one hole therethrough.

9. The electrical terminal block of claim 7 wherein the planar mounting member has a bottom side for bonding the case cover to a support surface.

* * * * *